United States Patent [19]

Svenning et al.

[11] Patent Number: 4,904,117

[45] Date of Patent: Feb. 27, 1990

[54] ACCESS APPARATUS CONNECTING A FIRST AND SECOND CHAMBER AT GREAT WATER DEPTHS

[75] Inventors: Bjørnar Svenning, Trondheim, Norway; Rune Swensson, Höllviken; Lars Truedsson, Klagstorp, both of Sweden

[73] Assignee: Den Norske Stats Oljeselskap A.S., Norway

[21] Appl. No.: 157,866

[22] Filed: Feb. 19, 1988

[30] Foreign Application Priority Data

Feb. 23, 1987 [NO] Norway ..... 870704

[51] Int. Cl.[4] ..... B63C 11/34

[52] U.S. Cl. ..... 405/189; 405/192

[58] Field of Search ..... 405/185, 188, 189, 192; 114/312, 313

[56] References Cited

U.S. PATENT DOCUMENTS 1,952,080 3/1934 Lake .
1,963,996 6/1934 Lake .
1,969,941 8/1934 Pegg ..... 405/189
3,640,079 2/1972 Le Therisien et al. ..... 405/189
3,656,771 3/1972 Greene ..... 405/189
3,739,589 6/1973 Wolfe ..... 405/189

FOREIGN PATENT DOCUMENTS 142953 11/1980 Norway .

*Primary Examiner*—David H. Corbin
*Attorney, Agent, or Firm*—Lucas & Just

[57] ABSTRACT

Access apparatus between a first and second chamber (1, 2) located at greater water depths, which chambers have equal pressure, lower than the water pressure, particularly an access apparatus (4) between an underwater vessel (1) and a chamber (2) at an installation on the seabed. The invention is characterized in that it comprises first and second concentric tubular elements (7, 5) designed for engagement as a telescopic cylinder, a hydraulic system for controlled actuation of the telescopic cylinder and at least on the free end of the first tubular element (7), a spherical mounted mating flange (12).

6 Claims, 6 Drawing Sheets

ACCESS APPARATUS CONNECTING A FIRST AND SECOND CHAMBER AT GREAT WATER DEPTHS

Figure 1:
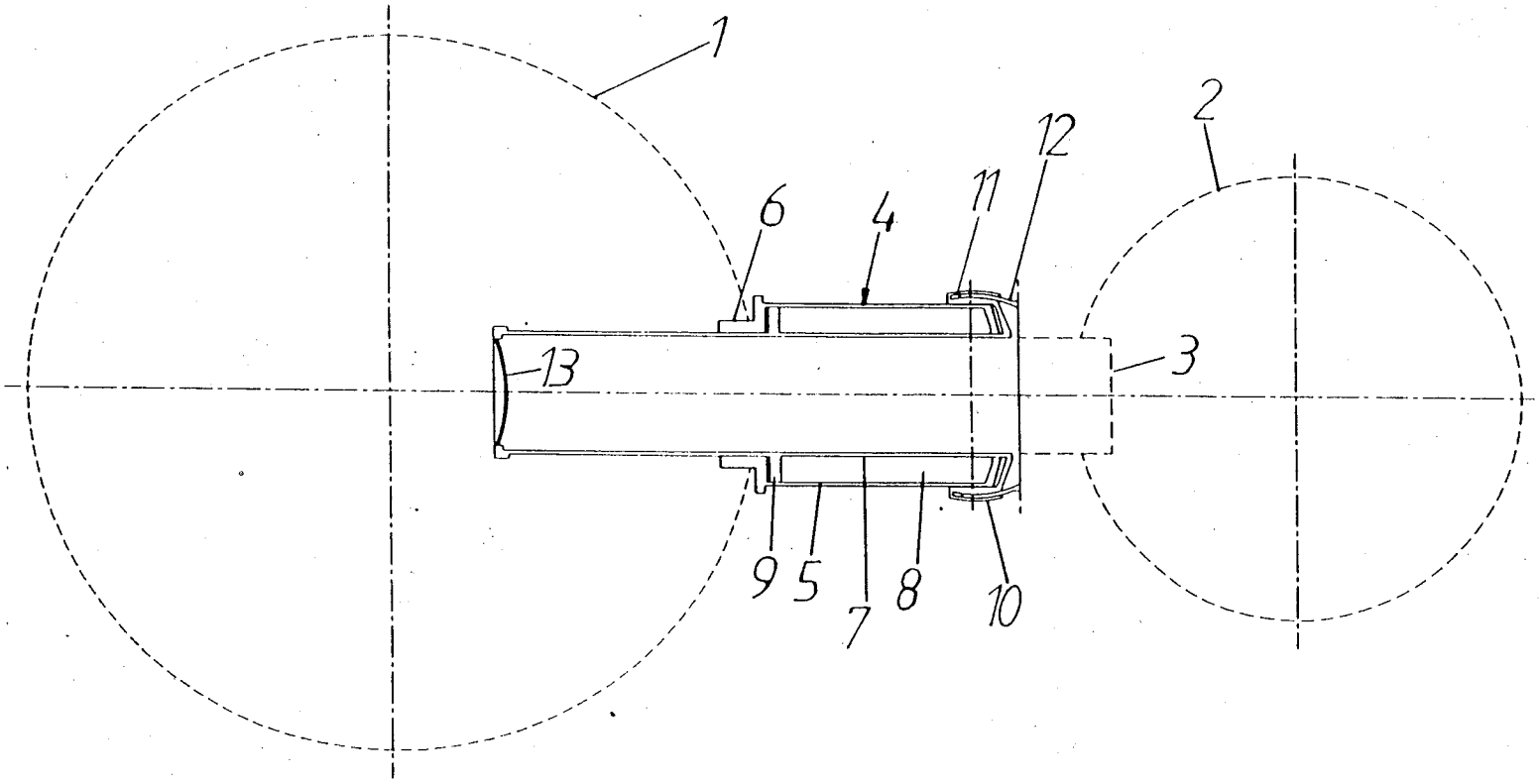

The invention relates to an access apparatus connecting a first and second chamber at great depths of water, the chambers having equal pressure, lower than the water pressure, in particular an access apparatus between an underwater vessel and a chamber in an installation on the sea bed.

The present invention is specially developed to solve the problems encountered when it is desirable to connect an underwater vessel to a mono-atmospheric chamber for the purpose of well servicing and workover, but naturally is not limited to such use. Exemplary connection is carried out primarily to make access possible for personnel. Such an access apparatus has to meet several criteria. For instance, the access apparatus should be designed so that it can overcome minor spatial variations during connecting/disconnecting. In a connected condition, it is also preferable that the access apparatus should be capable of compensating for minor variations of distance between the two connected chambers. There is also a definite need for compensation of minor dislocations apart from pure variations of distance. It is also desirable for the access apparatus to be designed so that the one chamber and the access apparatus shall not press against the other chamber.

As a practical example, reference can be made to the conditions pertaining to an underwater vessel with associated work module, as shown and described in Norwegian patent application no. 850957. When the work module and the underwater vessel are mated without special precautions being taken, a very rigid connection will be obtained, which will be subject to great strain if the chambers (work module and underwater vessel) shift their positions in relation to each other. By way of example, the work module will be attached to the top of a production tree, whilst the work module is utilized as a chamber for well servicing and workover, and there is a danger of the work module being able to move its position in relation to the underwater vessel, which is supposed to be landed and resting or locked to a frame structure in the underwater installation. In addition it is naturally necessary for the two chambers to be very accurately positioned in relation to each other, so that the sealing flanges engage properly before the pressure inside the connection is reduced.

According to the invention, an access apparatus, as mentioned initially, is proposed, characterized by its comprising first and second concentric tubular elements designed for cooperation as a telescopic cylinder, a hydraulic system for controlled actuation of the telescopic cylinder and at least at the free end of the first tubular element, a spherically mounted mating flange.

With such an access apparatus the above mentioned criteria are met. The telescopic design enable the accommodation of a mutual distance between the mating and flange and the adjacent chamber during connecting/disconnecting. In the connected condition, minor positional movements between the two chambers are accommodate as a result of the telescopic design. Other relative movements will be accommodated by the utilization of the spherical mounting.

The access apparatus according to the invention is suited to connecting and disconnecting whilst utilizing the seawater pressure. A preferred embodiment of the access apparatus with respect to this objective is characterized by the hydraulic system being comprised by a seawater/hydraulic medium connected to the telescopic cylinder's push-out actuation face and a chamber-atmospheric/hydraulic medium accumulator connected to the telescopic cylinder's push-in actuation face.

The said second tubular element can be rigidly attached to one of the chambers, but a particularly advantageous embodiment is characterized by the second tubular element being mounted onto one of the chambers with a spherical bearing. Thus, the apparatus is given increased ability to accommodate and equalize relative movements between the two chambers.

Suitably, a practical embodiment of the invention is characterized in that the said first tubular element is the inner telescope element and is provided with a ring collar which forms a piston, actuated by the hydraulic system, in the annular space between the two concentric tubular elements.

Figure 2:
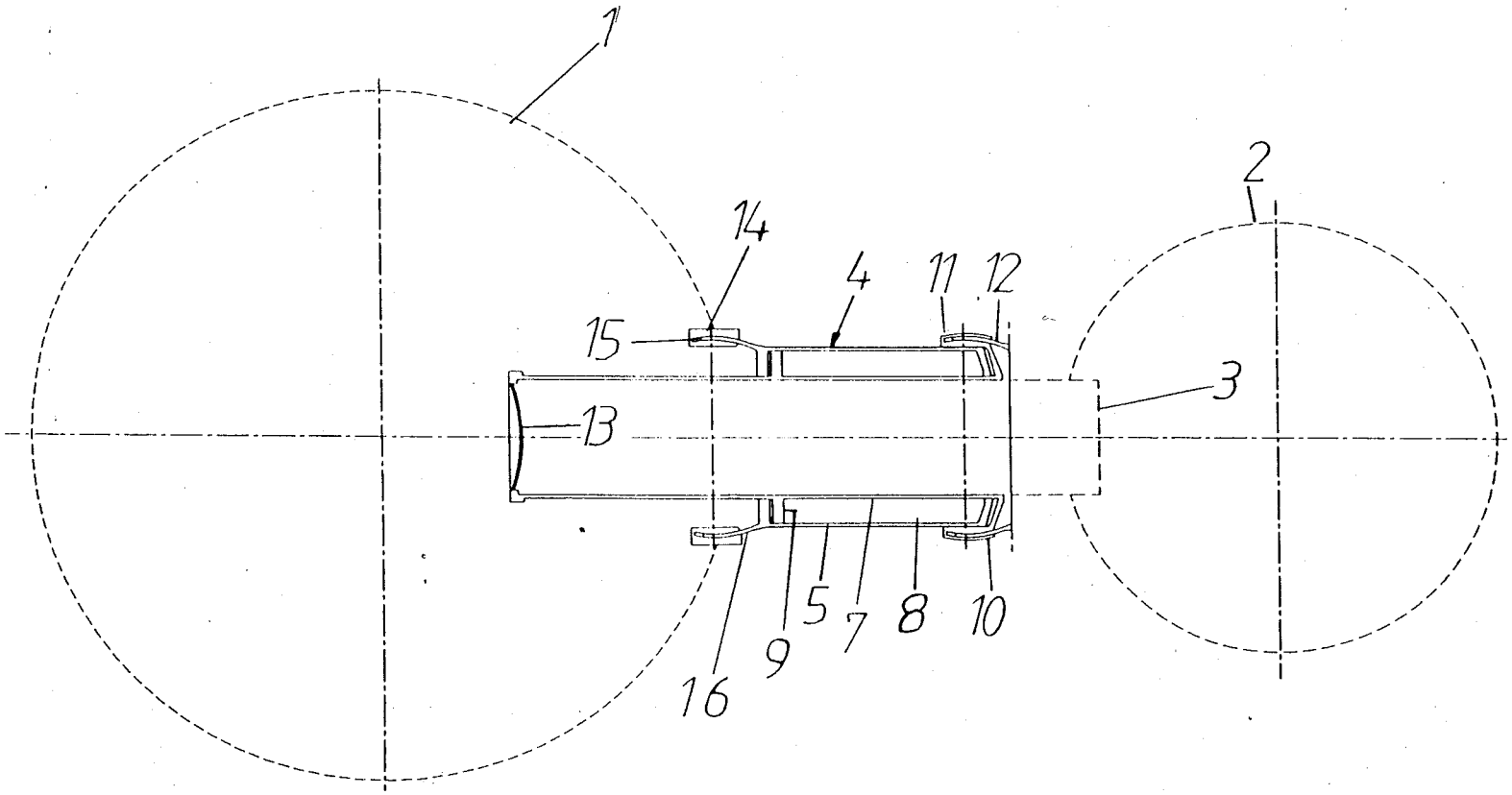
Figure 3:
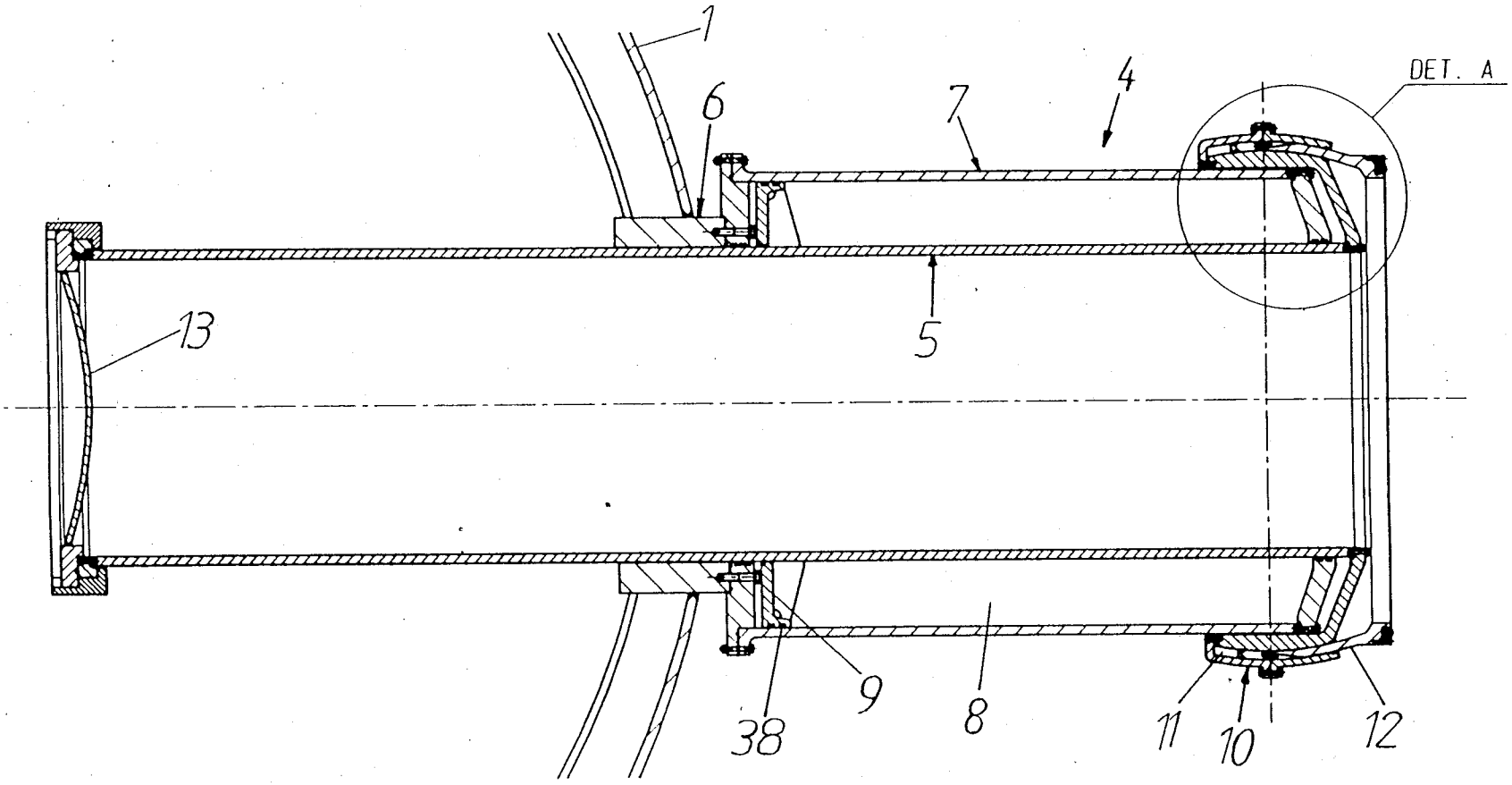
Figure 4:
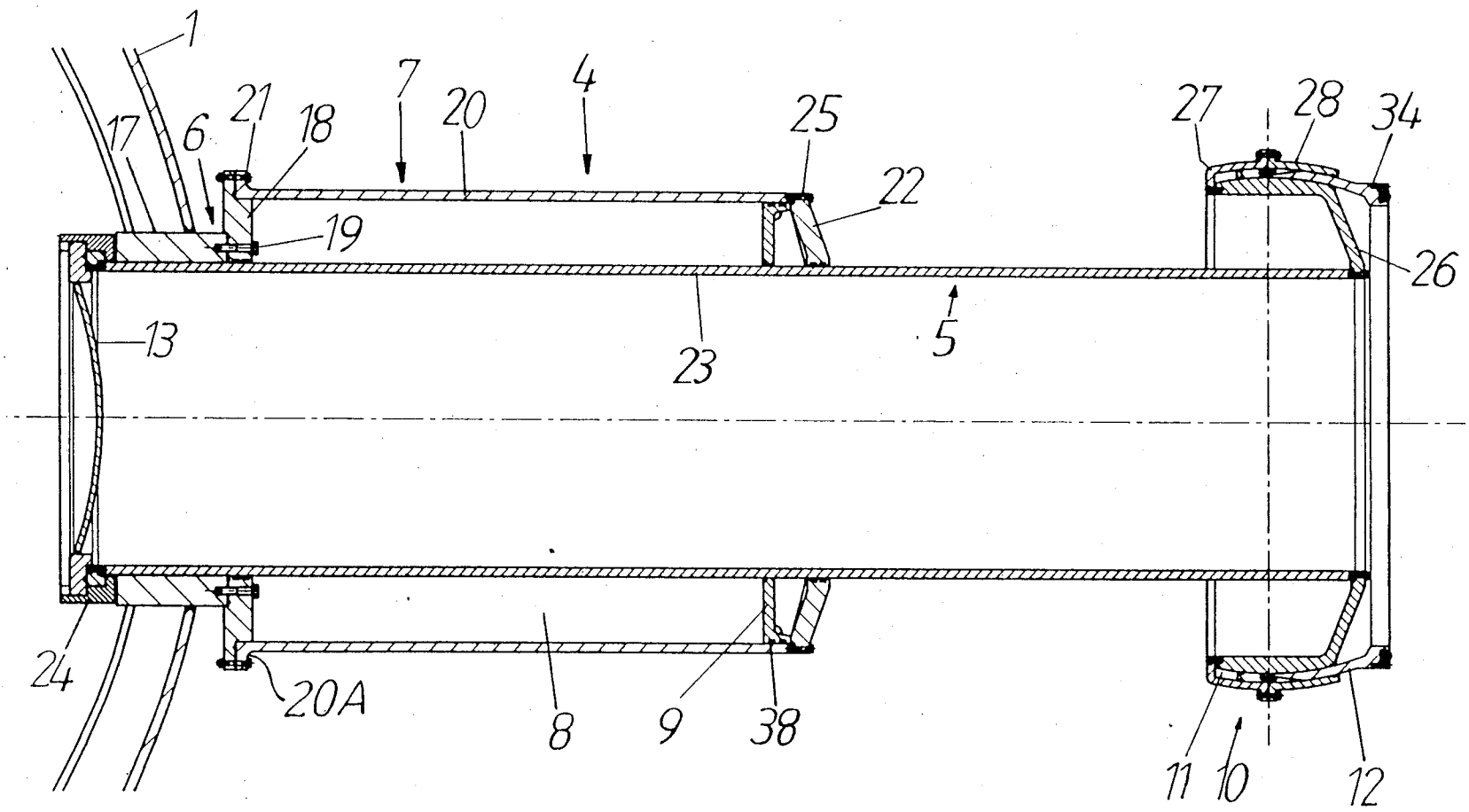
Figure 5:
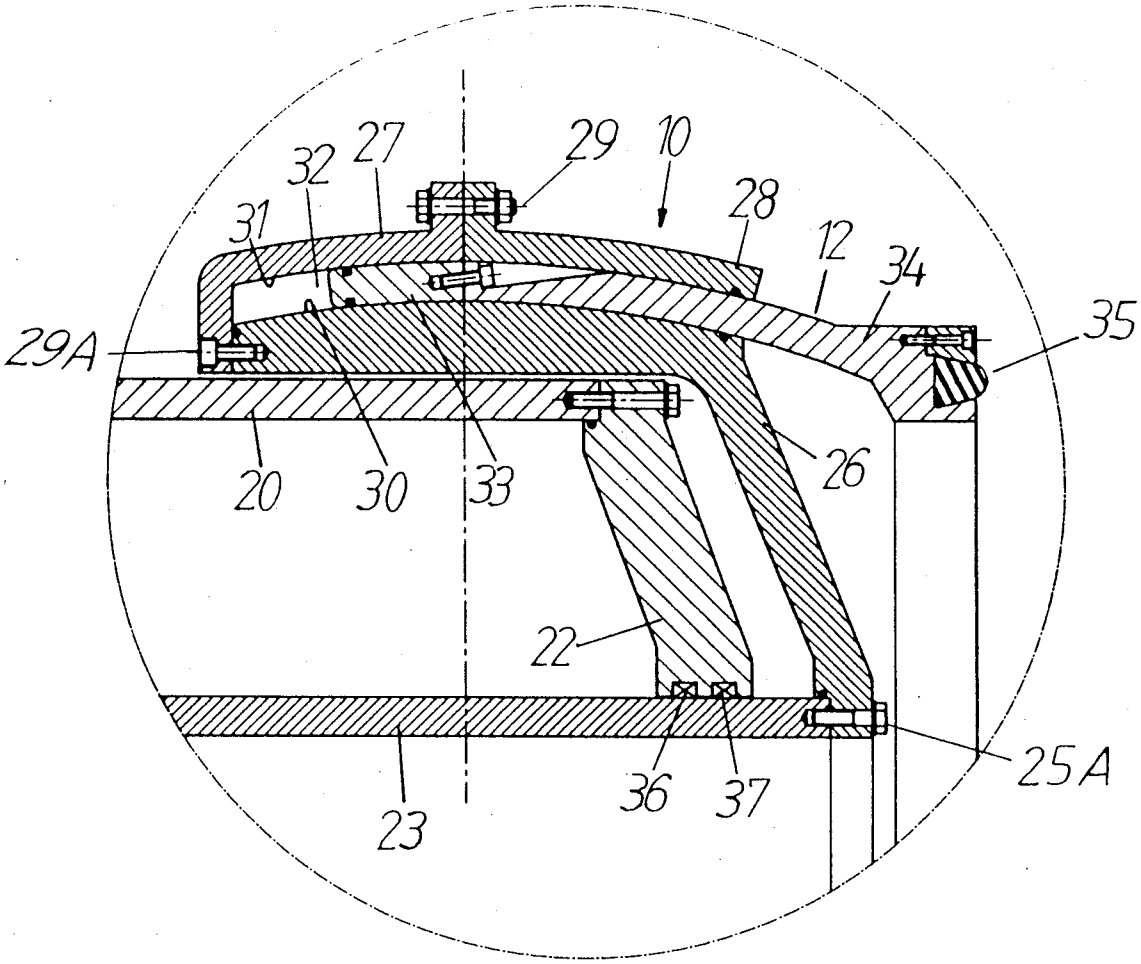
Figure 6:
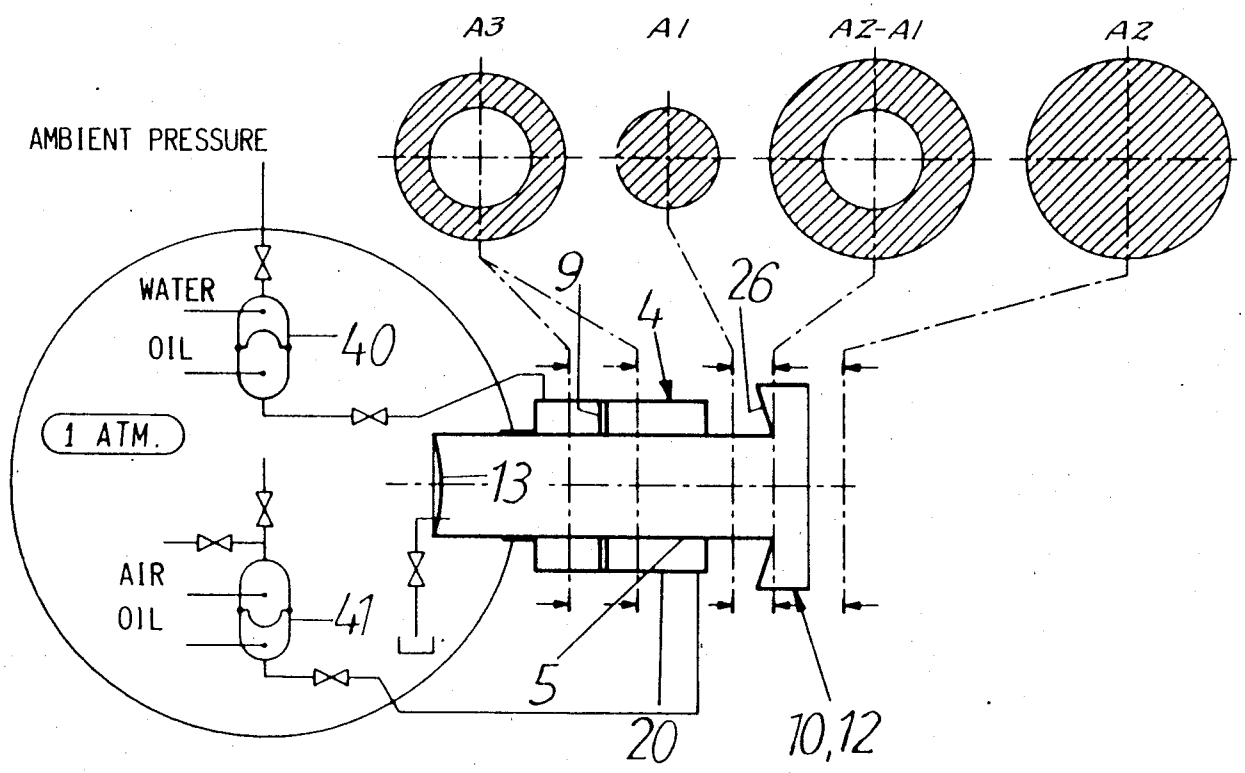

The invention will be described in more detail with reference to the drawings, where:

FIG. 1 schematically shows an access apparatus according to the invention, structurally mounted in one of the chambers, FIG. 2 shows schematically another embodiment of the access apparatus according to the invention, spherically mounted in one of the chambers, FIG. 3 shows a more detailed longitudinal section in a larger scale of an access apparatus of the type which is shown in FIG. 1, with the telescope cylinder in the non-extended or retracted position, FIG. 4 shows, the embodiment in FIG. 3 in the extended position, FIG. 5 shows a portion of the area encirculated in FIG. 3 and FIG. 6 shows an example of an embodiment of a preferred hydraulic system which is a part of the access apparatus according to the invention.

In FIG. 1 it will be assumed that the stippled circle 1 represents a cross-section of an underwater vessel which is to be coupled together with a chamber 2. The chamber 2 has an access hatch 3 not further shown, while there is an access apparatus 6 mounted onto the underwater vessel 1 consisting mainly of an outer tubular formed element 5 which is attached at 6 to the underwater vessel as well as an inner and concentrically arranged tubular element 7 which is slideably and sealingly arranged in the outer tubular element 5. Between the two tubular elements 5 and 7 an annular space 8 is formed wherein a ring collar 9, placed on the inner tubular element 7, acts as a piston.

The inner tubular element's 7 free or outer end is provided with a ring collar shaped housing 10 which is provided with a ring shaped spherical bearing recess 11 for a corresponding spherically designed ring 12. This spherically designed ring 12 acts as a mating flange for sealing engagement with the area around the chamber's 2 access hatch 3. In the inner tubular element's 7 other end, against the underwater vessel's 1 inner facing end, the element 7 has an access 13.

It will be understood that if pressure medium is applied to the left side of the piston 9 shown in FIG. 1, the element 7 will be displaced towards the right, so that the mating flange 12 is brought into sealing engagement around the access hatch 3. This movement is indicated by stippled lines in FIG. 1. The displacement of the inner tubular element 7 to the right in FIG. 1 prerequisites a corresponding venting of the annular space to the right of the piston 9 . Means for the here mentioned pressurizing/draining of the annular space are not shown in FIG. 1, but a preferred hydraulic system which can be used, will be described in more detail in the following, with reference to FIG. 6.

The embodiment of the access apparatus which is shown in FIG. 2, is in general assembled in the same manner as in FIG. 1 and the same reference numerals are therefore used for corresponding components. The only difference with respect to the embodiment in FIG. 1 is that the embodiment in FIG. 2 has a spherical bearing of the outer tubular element 5 in the underwater vessel 1. This spherical bearing comprises mainly a ring-formed housing 14 with a ring-formed spherical receptacle 15 for a spherical ring 16 which is attached to the outer tubular element 5. The access device is then, according to FIG. 2, capable of moving in relation to both the underwater vessel 1 and the chamber 2, since the outer tubular element 5 can move freely in relation to the underwater vessel 1, while the inner tubular element 7 can move freely in relation to the chamber 2, i.e. relative to the mating flange 12 situated against the chamber 2.

As mentioned, FIG. 3–5 show the embodiment in FIG. 1 in a larger scale and in greater detail. In FIG. 3–5, the same reference numerals are therefore used as in FIG. 1, as far as it is found suitable.

In the underwater vessel's 1 hull a strong ring 17 is welded into an opening. A ring-formed base-end 18 is secured to the ring 17 by means of bolts 19. Tube 20 provided with a flange 20A at one of its ends, is fastened to the ring-formed base-end 18, by means of flange bolts 21. At the other end of the tube 20, a conical, ring-formed outer base end 22 is attached to the tube by means of bolts 25. The above described elements 18, 20 and 22 constitute the outer tubular element 7 previously described in connection with FIG. 1.

The inner tubular element 5 comprises a tubular body 23 which in one of its ends, in this case the end extending into the underwater vessel 1, is provided with an opening collar 24 for accommodation of the access hatch 13. In the other, outer end the tube 23 has ring-formed housing 10 mounted onto it. This ring-formed housing 10, as shown in FIG. 5, is attached to the tube 23 by means of bolts 25A. The housing 10 is assembled of one inner ring-formed part 26 and two exterior ring-formed parts 27,28 which are bolted together as shown in 29. The outer ring part 27 is attached to the inner housing part 26 by means of bolts 29A. Between the inner ring-formed part 26 and the exterior ring-formed part 27, 28, a receptacle 32 for the spherical ring body 12, is obtained by machining the facing surfaces 30, 31 into a spherical form. This spherical ring body 12, as shown in FIG. 5, consists of two parts, namely an inner ring 33 and an outer ring 34. The outer ring 34 supports a fastly attached washer 35 intended for sealing engagement with the area around the access hatch 3 to the chamber 2 (see FIG. 1).

The required sealing between the two telescopic elements 5 and 7 is not shown in any more detail, with the exception of in FIG. 5, where washers 36, 37 which form a sealing between the base end 22 and the tube 23 are shown.

The piston 9, as shown in FIG. 3 and 4 is designed as a ring element which is welded onto the tube 23. The piston's peripheral surface is sealed against the inner wall of the tube 20 by means of indicated washers 38.

FIG. 6 shows a hydraulic system for the access apparatus, where the surrounding seawater pressure is utilized in an advantageous manner for actuation of the telescope cylinder and for holding of the mating flange against the adjacent chamber wall.

In FIG. 6 the same reference numerals are used as for the embodiment according to FIG. 1 and 3–5 and only the most essential components are given corresponding reference numerals.

To gain understanding of the functioning of the arrangement in FIG. 6, the most important areas are those referred to as A1, A2 and A3.

These areas are dimensioned so that the access apparatus will be balanced and at the same time achieving a necessary pressure against the mating flange in order to press the mating flange into sealing engagement with the chamber 2 not shown in FIG. 6. This pressure will be sufficient to maintain he connection and thus hydraulic work cylinders or similar means are not necessary. Moreover, forces are avoided which will try to move the not shown chamber 2 and the access apparatus 4 against the underwater vessel 1 when the connection is achieved and the passage through the access apparatus is open.

In order to ease the understanding, there will in the following be given a numerical example where it is assumed that the inner diameter of the tube 5 is 84 cm, the diameter of the mating flange is 125 cm and the diameter of the tube 20 is 120 cm. For the shown cross-sectioned areas A1, A2 and A3 the following dimensions will apply.

$$A1 = \frac{\pi \times 84^2}{4} = 5542 \text{ cm}^2$$

The area A2 will be $$A2 = \frac{\pi \times 125^2}{4} = 12272 \text{ cm}^2$$

The area A3 will be $$A3 = \frac{\pi\,(1202 - 84^2)}{4} = 5768 \text{ cm}^2$$

When the tube 5 with the mating flange 12 is to be moved towards the not shown chamber 2, the ambient water pressure P will act on the area Al, thus preventing this movement. This is balanced by the ambient water pressure P being admitted into the ring-formed area A3. This is carried out by seawater being admitted into the water/oil accumulator 40 which will transmit this pressure to the piston 9. Since the area A3 is slightly larger than the area Al, a positive force occurs in an outward direction. This force is however counteracted by the pressure which will build up in the ring volume outside the ring-formed piston 9. This volume must therefore be drained in a controlled manner and this takes place by means of the oil/air accumulator 41. The accumulator's air section is vented to atmospheric pressure inside the vessel 1. In this way a controlled outward movement of the tube 5 is achieved.

When contact is achieved between the mating flange 12 and the chamber 2 the pressure inside the tube 5 is reduced and water is pumped out. A force F is then achieved between the access apparatus and the chamber 2. This force F will be $$F=P(A2-A1)$$

It should be pointed out here that the balance between the areas Al and A3 is maintained because the tube 5 and the chamber act now together in the same way as prior to the connection. The area A1 which is influenced by the surrounding water pressure is "moved" to the other side of the not shown chamber 2.

In the case of disconnection, this is carried out by the access hatches being closed and the tube 5 filled with water. The pressure inside the tube is increased to the surrounding pressure. Water from the oil/water accumulator 40 is admitted into the underwater vessel 1. The tube 5 will then move in a direction towards the underwater vessel 1. While this is taking place, the air/oil accumulator 41 must be open to both the underwater vessel and to the volume on the outside of the piston 9, so that this volume can be filled with oil from the accumulator 41.

We claim:

1. An apparatus for access between a first and second chamber located underwater wherein said first and second chamber are at equal pressure, the apparatus comprising:

(a) an outer tubular member having one end attachable to a first chamber;

(b) an inner tubular member positioned concentrically inside said outer tubular member and in sliding arrangement with said outer tubular member, said inner tubular member having one end facing said first chamber and another end facing away from said first chamber, said inner tubular member and said outer tubular member defining a ring room therebetwen;

(c) a mating means for forming a seal around portion of a second chamber, said mating means attached to the other end of said inner tubular member;

(d) a ring shaped member attached eternally to said inner tubular member and forming a hydraulic piston arrangement in said ring room; and (e) a hydraulic system for actuating movement of said inner tubular member by means of said hydraulic piston arrangement.

2. The apparatus according to claim 1, wherein the hydraulic system includes means for extension of the inner tubular member by means of seawater pressure, and means for controlled reduction of counter-pressure.

3. The apparatus according to claim 1, wherein said ring room is divided by said ring member into one side that faces said first chamber and another side that faces said second chamber; and the hydraulic system is comprised of a seawater/hydraulic medium accumulator connected to the one side of said ring room and a chamber atmosphere/hydraulic medium accumulator connected to the other side of said ring room.

4. The apparatus according to claim 1, wherein the outer tubular member is rigidly attached to said first chamber.

5. The apparatus according to claim 1, wherein the outer tubular member is attached to the first chamber with a spherical bearing.

6. The apparatus according to claim 1, wherein the mating flange is spherically mounted.

* * * * *